US005477783A

United States Patent [19]

Hashimura

[11] Patent Number: 5,477,783

[45] Date of Patent: Dec. 26, 1995

[54] THIN FILM-FORMING APPARATUS

[75] Inventor: Yasuhiro Hashimura, Kyoto, Japan

[73] Assignee: Nissha Printing Co., Ltd., Kyoto, Japan

[21] Appl. No.: 185,802

[22] PCT Filed: Apr. 18, 1994

[86] PCT No.: PCT/JP92/00966

§ 371 Date: Jan. 28, 1994

§ 102(e) Date: Jan. 28, 1994

[87] PCT Pub. No.: WO93/02863

PCT Pub. Date: Feb. 18, 1993

[30] Foreign Application Priority Data

Jul. 31, 1991 [JP] Japan ..... 3-215927
Aug. 13, 1991 [JP] Japan ..... 3-228747

[51] Int. Cl.[6] ..... B41F 3/81; B41F 3/00

[52] U.S. Cl. ..... 101/158; 101/356

[58] Field of Search ..... 101/150, 158, 101/170, 157, 161, 169, 212, 250, 349, 350, 363, 148, 353, 358, 357, 356

[56] References Cited

U.S. PATENT DOCUMENTS 3,467,008 9/1969 Domoter ..... 101/142
4,625,643 12/1986 Davis .
4,841,857 6/1989 Hashimura et al. .

FOREIGN PATENT DOCUMENTS 0115854 8/1984 European Pat. Off. .
53-707 1/1978 Japan .
58-21860 2/1981 Japan .
56-142089 11/1981 Japan .
58-201653 11/1983 Japan .
62-53347 11/1987 Japan .
63-236651 10/1988 Japan .
3-11630 2/1991 Japan .
2146291 4/1985 United Kingdom .

*Primary Examiner*—J. Reed Fisher
*Attorney, Agent, or Firm*—Wenderoth, Lind & Ponack

[57] ABSTRACT

A thin film-forming apparatus includes: an anilox roll having a large number of ink cells, an ink supply device for charging ink into the ink cells of the anilox roll, a printing roll having a projection which contacts the anilox roll is transferred and transferring the ink in the ink cells of the anilox roll is transferred to the projection, and a printing table for holding a material to be printed and bringing the material into contact with the projection of the printing roll so as to transfer the ink on the projection of the printing roll to a surface of the material. A first driving device is provided for rotating the anilox roll, a second driving device is provided for rotating the printing roll independently of the anilox roll, and a control device is provided for controlling the first and second driving devices so that the difference in the rotational speeds between the anilox roll and the printing roll is within a predetermined range. The anilox roll and the printing roll are driven independently of each other by the control device so that the difference in the rotational speeds between the anilox roll and the printing roll is within a predetermined range. The apparatus is capable of forming a smoothing thin film with a more uniform thickness on the material.

8 Claims, 3 Drawing Sheets

THIN FILM-FORMING APPARATUS

TECHNICAL FIELD

The present invention relates to an apparatus capable of forming a thin film of a uniform thickness.

Background Art

As a thin film-forming apparatus for forming a high molecular thin film pattern such as a liquid crystal-oriented film for use in electronic components, for example, the following apparatus as shown in FIG. 5 is proposed (Examined Japanese Patent Publication No. 3-11630). The apparatus comprises an anilox roll 150 having a great number of ink cells 150*a* on the periphery thereof; an ink supply device 151 for charging ink into the ink cells 150*a;* a printing roll 152 having projections 152*a* to which the ink of the anilox roll 150 is transferred; and a printing table 154 for fixing thereto a material to be printed 153 to which the ink of the printing roll 152 is transferred. This thin film-forming apparatus is so constructed that the printing roll 152 and the anilox roll 150 are synchronously driven by a driving motor 155 for driving the printing roll 152 via a pair of pinions 156 and 156 so as to form a thin film on the material 153 in a uniform thickness.

However, even though the anilox roll and the printing roll are to be synchronously driven by the pair of pinions, there is a play between the pinions. As a result, nonuniform rotation or backlash is liable to occur between the anilox roll and the printing roll and thus the difference in the rotational speed between the anilox roll and the printing roll cannot be set to a desired value. Consequently, it is difficult to form a thin film with a uniform thickness.

It is therefore an object of the present invention to solve the above-described disadvantage and provide a thin film-forming apparatus capable of setting the difference in the rotational speeds between the anilox roll and the printing roll to a desired value and forming a smoother thin film with a more uniform thickness on a material to be printed.

Summary of the Invention

In accomplishing the above object, according to the present invention, the anilox roll and the printing roll are driven independently of each other and controlled set the difference in the rotational speeds between the anilox roll and the printing roll within a predetermined range.

That is, according to one aspect of the present invention, a thin film-forming apparatus comprises: an anilox roll having a large number of ink cells; an ink supply device for charging ink into the ink cells of the anilox roll; a printing roll having a projection contacting the anilox roll and transferring the ink in the ink cells of the anilox roll to the projection; a printing table for fixing a material to be printed thereto and bringing the material into contact with the projection of the printing roll so as to transfer the ink on the projection of the printing roll to a surface of the material; a first driving device for rotating the anilox roll; a second driving device for rotating the printing roll independently of the anilox roll; and control means for controlling the first and second driving devices so that the anilox roll and the printing roll rotate synchronously.

According to another aspect of the present invention, a thin film-forming apparatus comprises: an anilox roll having a large number of ink cells; an ink supply device for charging ink into the ink cells of the anilox roll; a printing roll having a projection contacting the anilox roll and transferring the ink in the ink cells of the anilox roll to the projection; a printing table for fixing a material to be printed thereto and bringing the material into contact with the projection of the printing roll so as to transfer the ink on the projection of the printing roll to a surface of the material; a first driving device for rotating the anilox roll; a second driving device for rotating the printing roll independently of the anilox roll; and control means for controlling the first and second driving devices so that a difference in rotational speeds between the anilox roll and the printing roll is greater than 0% and equal to or smaller than 1%.

According to the above-described construction, first, ink is supplied to the ink cells of the anilox roll by the ink supply device and pressed into the ink cells of the anilox roll, and then, an excessive amount of ink is scraped therefrom. Then, the first and second driving devices are driven, and the control means controls the first and second driving devices so that the difference in the rotational speeds between the anilox roll and the printing roll is zero, i.e., the anilox roll and the printing roll rotate synchronously or the difference in the rotational speeds between the anilox roll and the printing roll is within a predetermined range. As a result, the ink in the cells of the anilox roll is more uniformly transferred to the projection of the printing roll. Based on a predetermined pattern formed on the projection, the ink applied to the projection is transferred to the surface of the material. In this manner, a thin film is formed on the material.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
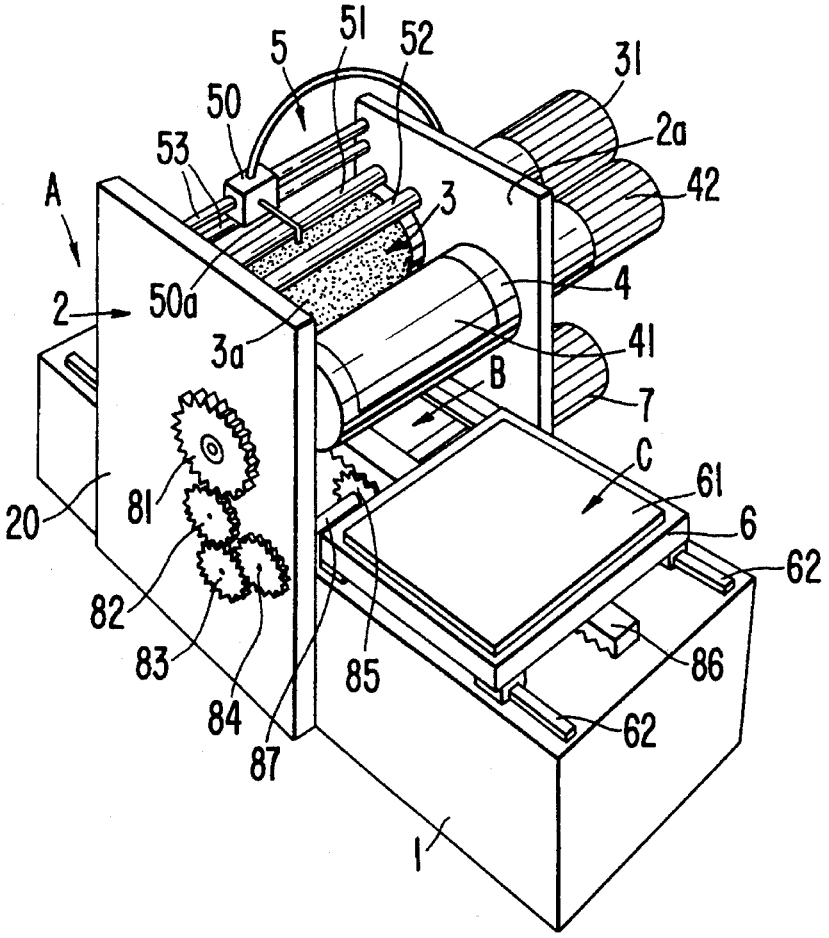
FIG. 1 is a perspective view showing an embodiment of a thin film-forming apparatus according to the present invention.

Before the description of the present invention proceeds, it is to be noted that like parts are designated by like reference numerals throughout the accompanying drawings.

An embodiment of the present invention will be described in detail below with reference to FIGS. 1 through 4.

In a thin film forming apparatus as shown in FIG. 1, reference numeral 1 denotes a base; 2 denotes a supporting frame comprising a pair of supporting walls 2*a* and 2*a* opposed to each other; 3 denotes an anilox roll; 4 denotes a printing roll; 5 denotes an ink supply device; and 6 denotes a printing table.

The supporting frame 2 is formed in the center of the rectangular base 1, and the anilox roll 3 and the printing roll 4 are rotatably supported by the supporting frame 2. The ink supply device 5 is disposed above the anilox roll 3. The printing table 6 is movably disposed on the upper surface of the base 1.

The drum of the anilox roll 3 is fixed to the rotational shaft thereof and in the drum, a plated layer is formed on the surface of the core made of copper, and the plated layer has a large number of ink cells 3*a* formed on the entire surface thereof. The depth of each ink cell 3*a* is 10 micrometers to several tens of micrometers. The drum is in contact with a projection 41 of the drum of the printing roll 4 at a constant pressure. A motor 31 for driving the anilox roll 3 is installed on an end projecting from the supporting wall 2*a* and coinciding with one end of the rotational shaft of the anilox roll 3.

Figure 2:
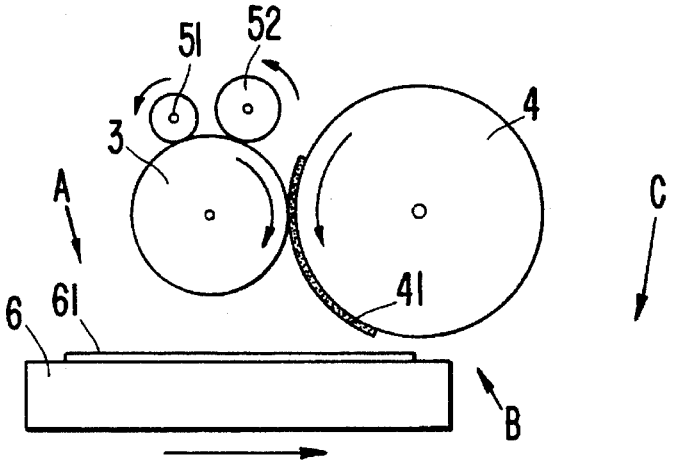
FIG. 2 is a schematic side elevational view showing the embodiment of the thin film-forming apparatus.
Figure 3:
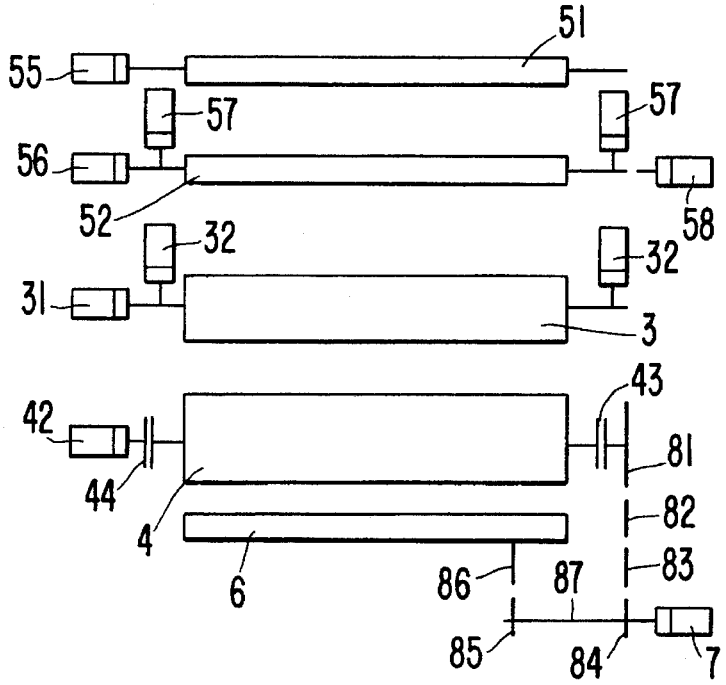
FIG. 3 is a concept view showing the driving mechanism of the thin film-forming apparatus.

The ink supply device 5 comprises an inking roll 51 and a doctor device 52. The doctor device 52 is composed of a doctor roll but can be composed of a doctor blade. A moving member 50 having an ink nozzle 50*a* moves in the axial direction of the inking roll 51 along two guide rails 53 installed on the supporting frame 2. Ink is supplied from the ink nozzle 50*a* to the peripheral surface of the anilox roll 3 in the range between the inking roll 51 and the doctor roll 52. The ink has a viscosity of several tens of c.p.s. to 30,000 c.p.s. and consists of a mixture of solvent and synthetic resin or resin precursor. As shown in FIG. 3, the inking roll 51 and the doctor roll 52 can be driven by motors 55 and 56, respectively. The doctor roll 52 can contact the anilox roll 3 at a varied pressure by two motors 57 and the position thereof in its axial direction can be adjusted by a motor 58. As shown in FIG. 2, when the anilox roll 3 rotates clockwise, the inking roll 51 rotates counterclockwise and thus ink dropped on the surface of the anilox roll 3 is spread over the surface of the anilox roll 3 and is charged into the ink cells 3*a* by the doctor roll 52. In this manner, an ink film is formed in a uniform thickness on the surface of the anilox roll 3.

A drum made of metal is fixed to the rotational shaft of the printing roll 4, and the drum has the projection 41 made of soft material, for example, consisting of rubber such as butyl rubber, synthetic resin such as nylon resin, photosensitive rubber, or photosensitive resin. The ink of the anilox roll 3 is transferred to the projection 41. A first pinion 81 is fixed to one end of the rotational shaft of the printing roll 4 which projects from the supporting wall 2*a*. A driving motor 42 for returning the printing roll 4 to its initial position is connected, via a clutch 44 (refer to FIG. 3.), with the other end of the rotational shaft of the printing roll 4 which projects from the supporting wall 2*a*.

The printing table 6 is placed on the base 1. As shown in FIG. 1, guide rails 62 are fixed on the upper surface of the base 1 along a range between a printing position (B) disposed between the pair of the supporting walls 2*a* of the supporting frame 2 and below the printing roll 4, an insertion position (A) for inserting material to be printed and which is disposed below the supporting walls 2*a* and on the material-supply side, and a material-discharge position (C) disposed below the supporting walls 2*a* and on the material-discharge side. The printing table 6 moves over the base 1 from the material-insertion position (A) to the material-discharge position (C) via the printing position (B) along the guide rails 62. The plate-shaped material to be printed 61 is placed in position on the upper surface of the printing table 6 and held thereby. A rack 86 parallel with the guide rails 62 is fixed to the lower surface of the printing table 6. A fifth pinion 85 engages the rack 86, and the printing table 6 reciprocates together with the rack 86 by the clockwise and counterclockwise rotation of the fifth pinion 85. The fifth pinion 85 is fixed to a printing table-driving shaft 87 rotatably mounted between the supporting walls 2*a*. A fourth pinion 84 is fixed to one end of the printing table-driving shaft 87 which projects from the supporting wall 2*a*, and a main motor 7 is mounted on the other end of the printing table-driving shaft 87 which projects from the supporting wall 2*a*. The main motor 7 drives the printing roll 4 and the printing table 6. The fourth pinion 84 is connected with a first pinion 81 via a third pinion 83 and a second pinion 82 both rotatably supported by one of the supporting walls 2*a* so that the rotational direction of the fifth pinion 85 is reverse to that of the first pinion 81. Therefore, the rotation of the printing roll 4 and the slide movement of the printing table 6 are synchronous with each other in positional relationship. The material 61 contacts the printing roll 4 at the printing position (B) of the printing table 6 and as a result, the ink of the projection 41 of the printing roll 4 is transferred to the surface of the material 61. In this manner, printing is carried out. Accordingly, the rotation of the printing roll 4 and the slide movement of the material 61 are mechanically accomplished in a smooth synchronization by the engagement among the first, second, third, and fourth pinions 81, 82, 83 and 84 and the engagement between the fifth pinion 85 and the rack 86.

As shown in FIG. 3, a toothed clutch 43 is provided between the printing roll 4 and the printing table 6 to prevent synchronous operation from occurring when printing operation is not carried out. This is to rotate the printing roll 4 constantly in the same direction and eliminate the need for rotating it in reverse. In this manner, it is unnecessary to perform a roll-separating operation to prevent the contact under pressure between the anilox roll 3 and the projection 41 of the printing roll 4. That is, in operating the driving motor 42 for returning the printing roll 4 to its initial position, the clutch 43 is disengaged to prevent the transmission of the driving force of the main motor 7 and then, the clutch 44 is engaged to transmit the driving force of the driving motor 42 to the printing roll 4 so as to rotate the printing roll 4 which has terminated the printing operation in the same direction as it rotates during the printing operation until the printing roll 4 returns to the initial position. When the printing operation is being performed, the clutch 44 is disengaged to prevent the transmission of the driving force of the driving motor 42 so that only the driving force of the main motor 7 is transmitted to the printing roll 4.

A mechanism for controlling the rotational speed of the anilox roll 3 and that of the printing roll 4 is described below.

Figure 4:
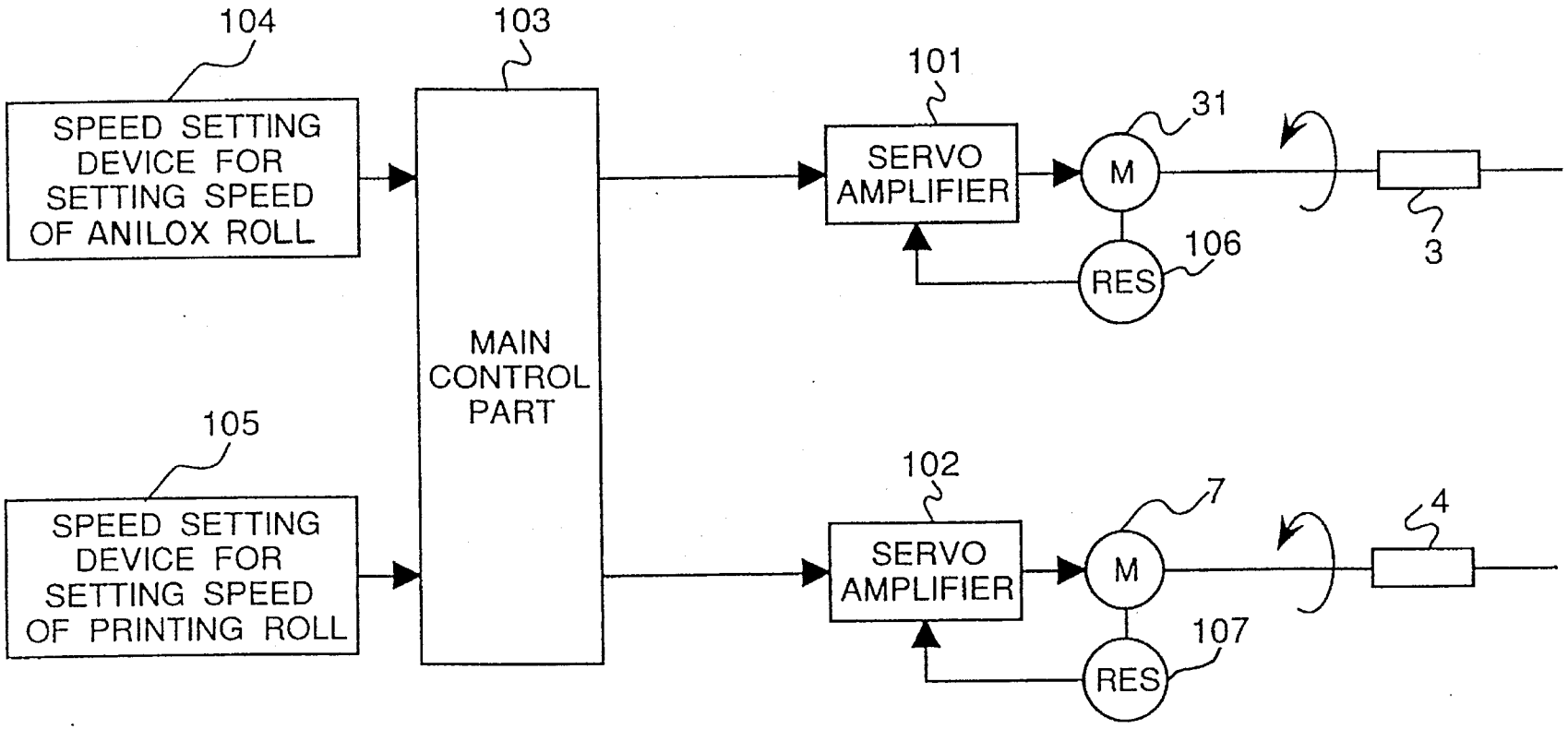
FIG. 4 is a block diagram showing the control mechanism of the thin film-forming apparatus.

FIG. 4 shows the control mechanism. The rotational speed of the anilox roll 3 and that of the printing roll 4 are set by setting devices 104 and 105, respectively. The rotational speeds set thereby are inputted to a main control part 103 and then instruction voltage signals (control signals) are outputted from the main control part 103. These signals are inputted to a servo amplifier 101 adapted for the anilox roll 3 and a servo amplifier 102 adapted for the printing roll 4. These amplifiers 101 and 102 control the anilox roll-driving motor 31 and the main motor 7, respectively and independently. The rotational speed of the anilox roll 3 and that of the printing roll 4 are detected by resolvers 106 and 107, respectively, and the detected results are inputted to the servo amplifiers 101 and 102 to control the rotation of the motors 31 and 7. The difference in the rotational speeds between the anilox roll 3 and the printing roll 4 is set to a desired value between 0 and 1% by the setting devices 104 and 105. Then, the value thus set is inputted to the main control part 103. Thus, the rotation of the anilox roll-driving motor 31 and that of the main motor 7 are controlled by the operation of the servo amplifiers 101 and 102 so that the difference in the rotational speeds between the anilox roll 3 and the printing roll 4 becomes the desired value. The reason why the difference in the rotational speeds between the anilox roll 3 and the printing roll 4 is set from 0 to 1% is that if the difference in the rotational speed therebetween is greater than this value, the projection 41 of the printing roll 4 is elastically deformed by the anilox roll 3 and thus a correct pattern printing cannot be accomplished.

The method for detecting the rotational speed (peripheral speed) of the anilox roll 3 and that of the printing roll 4 is described below. Supposing that the radius of the anilox roll 3 is (r), the peripheral speeds of both rolls 3 and 4 can be found by the following equation: (peripheral speed of anilox roll)=(number of rotations)=($2\pi r$). Otherwise, supposing that the pitch between the anilox roll 3 and the printing roll 4 is (P), the peripheral speed of the printing roll 4 can be found by the following equation: (peripheral speed of printing roll)= (number of rotations)=[$2\pi(P-r)$]. The method for finding the pitch P is described below. The anilox roll 3 is made of metal and the radius (r) thereof is constant. The cylinder (drum) of the printing roll 4 is made of metal and the radius (R) thereof is constant. The projection 41 of the printing roll 4 is made of resin and has a various thickness (t). The thickness (t) can be measured by a sensor. Thus, the relationship between the pitch between the anilox roll 3 and the printing roll 4 and these values can be found by equation $P=r+t+R$.

According to the above-described construction, ink is supplied to the ink cells 3*a* of the anilox roll 3 by the ink supply device 5 to press the ink into the ink cells 3*a* and then, an excessive amount of ink is scraped therefrom. Then, the material 61 is fixed to the printing table 6 at a predetermined position thereof and the printing table 6 is moved from the material-insertion position (A) to the material-discharge position (C). At this time, the toothed clutch 43 is engaged so that the main motor 7 and the driving motor 31 which are independent of each other rotate the printing roll 4 and the anilox roll 3 synchronously or at rotational speeds having a desired difference therebetween, under the control of the control mechanism. As a result of the rotation of the printing roll 4, the first pinion 81 rotates and as a result, the second, third, fourth, and fifth pinion 82, 83, 84, and 85 rotate and the printing table 6 moves to the material-discharge position (C) through the printing position (B) together with the rack 86 in synchronization with the rotation of the printing roll 4. At this time, the ink on the anilox roll 3 moves to the projection 41 of the printing roll 4 and is then transferred to the material 61.

In moving the printing table 6 backward from the material-discharge position (C) to the material-insertion position (A), the transmission of the driving force of the main motor 7 is cut off by the toothed clutch 43 and then, the main motor 7 is rotated in reverse. In this manner, the printing table 6 moves from the material-discharge position (C) to the material-insertion position (A) via the printing position (B) without rotating the printing roll 4 in reverse. The clutch 43 is disengaged and the clutch 44 is engaged to drive the driving motor 42 so as to return the printing roll 4 to its initial position.

Figure 5:
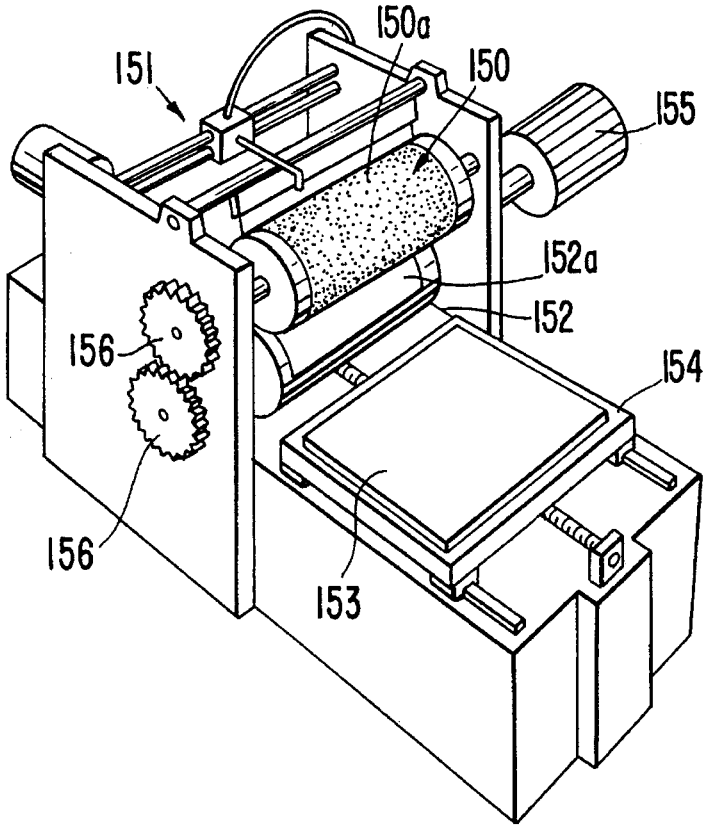
FIG. 5 (PRIOR ART)
FIG. 5 is a perspective view showing a conventional thin film-forming apparatus.

The thin film-forming apparatus according to the embodiment is compared with the conventional thin film-forming apparatus as shown in FIG. 5.

| Condition of apparatus according to embodiment | |
|---|---|
| anilox roll | diameter: 180 mm<br>rotational speed: 350 mm/second |
| inking roll | diameter: 80 mm<br>made of ethylene propylene rubber<br>contact pressure (converted into amount of ink charged into ink cell): 0.08 mm/<br>second rotational speed: 350 mm/second |
| doctor blade | made of plastic |
| printing roll | diameter: 250 mm<br>rotational speed: 350.3 mm/second |

-continued

| Condition of conventional apparatus | |
|---|---|
| anilox roll | diameter: 180 mm<br>rotational speed: 400 mm/second |
| inking roll | not provided |
| doctor blade | made of plastic |
| printing roll | diameter: 360 mm<br>rotational speed: 400 mm/second |

As shown in FIG. 5, the anilox roll and the printing roll of the conventional apparatus are synchronously rotated by a pair of pinions.

In the above-described condition, a thin film was formed on a glass base plate to measure the thickness of the thin film at 10 places. As a result, based on the mean value (x) of measured film thicknesses and the standard deviation ($\sigma$), $(\sigma/x)\times100$ is calculated as the percentage of smoothness. The smoothness was 7 to 10% according to the conventional apparatus while it was 5% according to the apparatus of the embodiment. The latter is superior to the former in smoothness. Thus, the latter is capable of forming a thin film with more uniform thickness than the former.

According to the embodiment, the anilox roll 3 and the printing roll 4 are not driven synchronously by the gear mechanism comprising the pinions etc. but by the motors 31 and 7 independent of each other, respectively. Therefore, the difference in the rotational speeds between both rolls can be set to a desired value from 0 to 1%. Thus, if the peripheral speed of the anilox roll 3 and that of the printing roll 4 are fully synchronous, i.e., if the difference in the rotational speeds between both rolls is zero, the ink of the anilox roll 3 is transferred to the projection 41 of the printing roll 4 in correspondence with the configuration of the ink cell of the anilox roll. Therefore, the apparatus of the embodiment allows the ink of the anilox roll 3 to be transferred to the projection 41 of the printing roll 4 more reliably than with the conventional apparatus and hence a smooth thin film to be formed with a uniform thickness on the material. If the peripheral speeds of both rolls are not fully synchronized but different from each other as slight as more than 0% and equal to or less than 1%, the ink on the anilox roll 4 is not transferred to the projection 41 of the printing roll 4 in correspondence with the configuration of the ink cells of the anilox roll, but the force acting on the projection of the printing roll in the direction of the peripheral surface thereof is applied to the ink, based on the difference between the rotational speeds of both rolls. Hence, the ink is flattened on the projection 41 and then, the flattened ink is transferred from the printing roll 4 to the material 61. Accordingly, a smoother thin film can be formed with a more uniform thickness on the surface of the material 61. In other words, according to the conventional pinions, the backlash between two pinions in mesh is so great that it is difficult to set the difference in the rotational speeds between the anilox roll 3 and the printing roll 4 to a desired value between 0 and 1%. But according to the embodiment, each roll is driven independently and the control mechanism sets the difference in the rotational speeds between both rolls to a desired value. Thus, the difference in the rotational speeds between both rolls can be controlled so that it is set to a desired value between 0 and 1%.

In addition, since the clutch 43 provided between the printing roll 4 and the printing table 6 cuts off a synchronous operation when the printing operation is not being performed, the printing roll 4 rotates in the same direction at all times and it is unnecessary to rotate it in reverse. Hence, the operation efficiency is high. Thus, it is unnecessary to perform a roll-separating operation to prevent the contact between the anilox roll 3 and the projection 41 of the printing roll 4 under pressure.

Further, since the anilox roll 3 and the printing roll 4 are driven by motors 31 and 7, respectively, the peripheral speed of the anilox roll 3 and that of the printing roll 4 can be adjusted independently of each other even though the amount of the contact under pressure between the anilox roll 3 and the projection 41 of the printing roll 4 is changed by a pair of contact amount-adjusting motors 32 (refer to FIG. 3) and in addition, a uniform contact amount can be obtained throughout the entire length of the rolls.

Although the present invention has been fully described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims unless they depart therefrom.

I claim:

1. A thin film-forming apparatus comprising:

an anilox roll having a plurality of ink cells;

an ink supply device for charging ink into the ink cells of the anilox roll;

a printing roll having a projection for contacting the anilox roll such that the ink in the ink cells of the anilox roll can be transferred to the projection;

a printing table for securing a material to be printed and bringing the material into contact with the projection of the printing roll so as to transfer the ink on the projection of the printing roll to a surface of the material;

a first driving device for rotating the anilox roll;

a second driving device for rotating the printing roll mechanically independently of the anilox roll; and control means for controlling the first and second driving devices to rotate the anilox roll and the printing roll, respectively, so that a rotational speed of the anilox roll is different than a rotational speed of the printing roll by greater than 0% and no more than 1%.

2. The thin film-forming apparatus as claimed in claim 1, further comprising:

first rotational speed-detecting means for detecting the rotational speed of the anilox roll and inputting a first rotational speed signal to the control means; and second rotational speed-detecting means for detecting the rotational speed of the printing roll and inputting a second rotational speed signal to the control means;

wherein the control means controls the first and second driving devices based on said first and second rotational speed signals.

3. The thin film-forming apparatus as claimed in claim 1, further comprising:

a third driving device for rotating the printing roll;

a first clutch operably interposed between said printing roll and said second driving device; and a second clutch operably interposed between said printing roll and said third driving device.

4. The thin film-forming apparatus as claimed in claim 3, wherein said second driving device is further operable to move said printing table between a material-insertion position, a printing position and a material-discharge position.

5. A thin film-forming apparatus comprising:

a frame;

an anilox roll rotatably mounted to said frame and having a plurality of ink cells;

an ink supply device mounted to said frame adjacent said anilox roll;

a printing roll rotatably mounted to said frame adjacent said anilox roll;

a printing roll rotatably mounted to said frame and having a flexible ink-receiving layer projecting from said printing roll, said printing roll being mounted adjacent said anilox roll such that, at given rotational positions, said flexible ink-receiving layer contacts said anilox roll;

a material-securing printing table movably mounted to said frame for movement from a material-insertion position in which material can be inserted thereon, a printing position in which material mounted on said printing table is contacted by said flexible ink-receiving layer, and a material-discharge position;

a first motor operably connected to said anilox roll for rotating said anilox roll;

a second motor operably connected to said printing roll for rotating said printing roll mechanically independently of said anilox roll; and control means for controlling said first and second motors to cause said anilox roll and said printing roll to rotate at respective rotational speeds which differ by greater than 0% and no more than 1%.

6. The thin film-forming apparatus as claimed in claim 5, further comprising:

first rotational speed-detecting means for detecting the rotational speed of the anilox roll and inputting a first rotational speed signal to the control means; and second rotational speed-detecting means for detecting the rotational speed of the printing roll and inputting a second rotational speed signal to the control means;

wherein the control means controls the first and second motors based on said first and second rotational speed signals.

7. The thin film-forming apparatus as claimed in claim 5, further comprising:

a third motor operably connected to said printing roll for rotating said printing roll;

a first clutch operably interposed between said printing roll and said second motor; and a second clutch operably interposed between said printing roll and said third motor.

8. The thin film-forming apparatus as claimed in claim 7, wherein said second motor is further operably connected to said printing table for moving said printing table between said material-insertion position, said printing position and said material-discharge position.

* * * * *